US006755331B2

(12) United States Patent
Rassias

(10) Patent No.: US 6,755,331 B2
(45) Date of Patent: Jun. 29, 2004

(54) LOCKING ACTION HOLSTER

(76) Inventor: John N. Rassias, 7678 Cedarwood Cir., Boca Raton, FL (US) 33434

( * ) Notice: Subject to any disclaimer, the term of this patent is extended or adjusted under 35 U.S.C. 154(b) by 96 days.

(21) Appl. No.: 10/181,014

(22) PCT Filed: Jan. 12, 2001

(86) PCT No.: PCT/US01/01142

§ 371 (c)(1),
(2), (4) Date: Oct. 3, 2002

(87) PCT Pub. No.: WO01/51876

PCT Pub. Date: Jul. 19, 2001

(65) Prior Publication Data

US 2003/0205594 A1 Nov. 6, 2003

Related U.S. Application Data

(60) Provisional application No. 60/175,659, filed on Jan. 12, 2000.

(51) Int. Cl.[7] ..... F41C 33/02

(52) U.S. Cl. ..... 224/243; 224/193; 224/661; 224/912; 42/70.11

(58) Field of Search ..... 224/193, 198, 224/660, 661, 663, 243, 247, 912; 42/70.11

(56) References Cited

U.S. PATENT DOCUMENTS

| | | | | |
|---|---|---|---|---|
| 2,577,869 A | * | 12/1951 | Adams | 224/193 |
| 5,421,497 A | | 6/1995 | Gilmore | |
| 5,467,909 A | * | 11/1995 | Resca et al. | 224/244 |
| 5,551,611 A | | 9/1996 | Gilmore | |
| 5,598,958 A | | 2/1997 | Ryan, III et al. | |
| 5,768,816 A | | 6/1998 | Rassias | |
| 6,149,042 A | * | 11/2000 | Rassias | 224/661 |
| 6,415,541 B1 | * | 7/2002 | Rassias | 42/70.11 |
| 6,585,209 B1 | * | 7/2003 | Mattingly | 248/309.1 |

* cited by examiner

*Primary Examiner*—Stephen K. Cronin
(74) *Attorney, Agent, or Firm*—Webb Ziesenheim Logsdon Orkin & Hanson, P.C.

(57) ABSTRACT

A locking action holster has a hip plate (2) and at least one adjustable mount (1). A shroud (45) may be secured to the adjustable mount (1) to form a strapless shoulder holster. The adjustable mount (1) may be reconfigured on the hip plate (2) to extend downwardly. A lower mount (30) is then connected with the adjustable mount (1) to form a rotary hinge (32). The shroud (45) may be secured to the lower mount (30), with strap (47) securing the lower mount (30) to a wearer's leg, thus forming a thigh holster.

27 Claims, 14 Drawing Sheets

LOCKING ACTION HOLSTER

This application claims the benefit of Provisional Application No. 60/175,659, filed Jan. 12, 2000.

BACKGROUND OF THE INVENTION

1. Field of the Invention

The invention is related to firearm holsters and, more particularly, to shoulder or thigh holsters.

2. Description of Prior Art

Existing shoulder and thigh holster harnesses, commonly referred to as holster rigs, carry the pistol in a loaded state. They are a combination of a leather or nylon pouch for the pistol and a series of connecting leather or nylon straps, buckles, snaps, swivels, back joiners and tie downs. The method of wearing the existing shoulder holster harnesses is to place one arm through the loop of leather or nylon strapping which contains the pistol holster secured to it, and to then put the opposing arm through the second shoulder loop. Once the loops are over both shoulders, each loop is adjusted by tightening each loop strap in relation to the other and buckling them. Both loops are connected to each other by adjoining back harness which is located at the top of the wearer's back. After both arms have sequentially been placed through their corresponding loops, each tie down is secured to the belt of the wearer on either side of the shoulder loops. At this point, the shoulder holster rig is suspended from both shoulders with the loaded pistol contained in its holster hanging from the loose fitting series of straps, buckles, snaps and swivels connected to the tie downs which can, and do, move loosely as the wearer sits, walks or runs.

As all existing shoulder holster rigs are thus loosely suspended, the position of the pistol is constantly changing, creating not only a change in the loaded handgun's position and accessibility, but also creating discomfort to the back and shoulders. For those not experienced in the wearing of a shoulder holster rig, it is akin to wearing a small backpack with weights under both armpits, a truly memorable and uncomfortable experience. Although carrying a loaded pistol in such a rig is dangerous, cumbersome, uncomfortable and disruptive of motor memory of the pistol's exact location during a moment of stress and responsive action, those who tolerate the deficiencies of existing shoulder holster rigs do so to conceal that they are carrying a pistol and no safer or better method of carry is currently available.

To add further to the deficiencies of existing shoulder holster rigs, when the wearer withdraws his pistol, depending on whether he has a vertical or horizontal shoulder rig, he must pull up horizontally to remove the pistol. In so doing, the pulling action against the tightness of the holster rotates the shoulder loop, suspending the holster and pulling against the joining harness connecting to the opposing shoulder loop. Under such force not only do the shoulder loops rotate, but the belt tie downs move with the actioning force of the draw so that the holster itself moves to the rear. Thus, two hands are required, one to draw the pistol, the other to grasp the holster so that it does not move while drawing. Additionally, two hands are required to reholster the pistol, one to hold the holster steady, the other to place the pistol into the holster.

Another significant disadvantage relative to the existing shoulder harnesses is that because of the positioning of the holstered pistol, spare magazines are attached to the opposing shoulder loops as a counterweight. This creates an unstable platform when rapidly trying to access a spare magazine during a reloading process. As the spare magazines of conventional shoulder holster rigs are carried under the shooting arm, pulling a spare magazine out of its holster under the shooting arm in order to reload the pistol detracts from the target acquisition or accurate firing under stress.

SUMMARY OF THE INVENTION

Because of the inherent deficiencies and dangers of existing holster harnesses, the holster of the present invention is designed so that it is in fact strapless. The invention is so designed to carry a concealed pistol under the shoulder of the wearer without any straps, buckles, snaps, belts, loops or back joiners.

Preferably, an adjustable mount is so configured to attach to a holster hip plate so that the holster can be height adjustably secured on said mount in relation to height adjustment bolt receiving holes on either side of a slide shroud. The pistol holster may thus be elevated upward directly under the arm of the wearer depending on the wearer's height in a secure, comfortable and rapidly accessible mode while at the same time offering superior concealability and safety of the holster.

Thus secured to the adjustable mount, the hip plate is secured to the wearer's trouser belt which preferably interweaves through belt slots in the hip plate. The holster contains the pistol and provides excellent protection against slippage and movement during active motions and drawing the pistol under stress.

The bearing weight of the pistol, holster and mount is transferred longitudinally onto the hip plate and then to the wearer's belt, relieving the annoying and unstable moving weight from the shoulders as in the manner of conventional shoulder holster.

As there is no moving weight of the pistol suspended from shoulder loops, straps, tie downs and back joiners, the holster provides excellent motor memory of the pistol's position to the wearer at all times, even during sitting, walking or running.

This new holster provides better concealability as there are no straps, buckles, tie downs or back joiners to cause their presence to "print" or "pattern" on the wearer's clothing, thereby evidencing the presence of a concealed weapon, which is the main reason for carrying a pistol in a shoulder holster.

As the new holster is an independent element, securely and comfortably mounted on the wearer's trouser belt, there is no need to allocate a counterweight spare magazine pouch suspended under the opposing shoulder; consequently, spare magazines can be placed in more accessible locations and not under the arm of the shooting hand, which greatly compromises accuracy and the reloading process. In any carry mode, spare magazines are carried on the opposite side of the shooting arm, as evidenced in the attached photos of a magazine change during shooting.

Preferably, the invention may be configured so that by simply rearranging the adjustable mount to be secured to the hip plate, which can be made of aluminum, high density polymer or rubberized material, the adjustable mount is pointed down instead of up, creating a thigh holster. By so doing, another adjustable mount can be attached, for example, through an aligning hole at the end of the first adjustable mount so that the corresponding holes of each end will be capable of receiving a sheathed bolt. This forms a rotary hinge so that the lower arm can rotate forward and backward in relation to the fixed upper adjustable mount. The design of the lower mount is preferably such that it accepts belting through two slots at the bottom end of the mount. Thereafter, the slide shroud of the holster is secured to the lower mount so that when the pistol is inserted, it will be along the thigh of the wearer. The purpose of this embodiment of the invention is to allow the benefits of security, safety, speed, lockability and unencumbered gross motor memory fast access to the pistol and to be able to transition the pistol from locked, unloaded, and trigger inoperative to drawn, loaded, cocked and trigger activated within a second or two for those officers and military personnel who must carry their pistol at thigh height, such as SWAT, ATF and hostage rescue teams. These teams must have their pistols at a much lower point of draw as the pistol is a secondary weapon to their submachine gun or shotgun gun. The above design allows such personnel the ability to sit, run and do other vigorous activity and to do so without concern of losing their pistol in a loaded state. When a belt is passed through two lower slots on the lower adjustable mount and buckled together on the thigh during movement, the pistol secured in the holster on the lower mount will swing in relation to leg movement. Conventional thigh holsters are made of very flexible nylon belting attached to the trouser belt and around the thigh which causes the weight of the pistol loaded thigh holster to constantly creep up the leg of the wearer in sitting, and to rotate around the leg in running and climbing thus creating doubt as to where the pistol's grip is at anytime. The thigh holster of the invention is thus more stable, comfortable and easier to access under stress.

The design of the hip plate of the holster is preferably configured so that the plate has several holes vertically situated on the plate so as to receive threaded bolts. The bolts may secure height adjustment belt guides on either side of the belt slots on the hip plate. As belts vary greatly in width and thickness and as it is most desirable to have a means of adjusting the fit of the belt to its most optimum functional position, each belt height adjustment guide resembles a simple mask in appearance in that its top has a minor indentation whereas its bottom has a more pronounced indentation. The holes in the belt height adjustment guides are centrally located on either end. With three vertical holes on either side of the belt slots of the hip plate, one can establish multiple height adjustments to perfectly accommodate a wide variety of belt widths to give proper support. The holes in the height adjustment belt guides are situated so that they not only match up with the horizontally situated hole on the other side of the corresponding belt slot, but also match up vertically to the hole above. In this way the height adjustment belt guides can be uniquely and securely stored if the widest possible belt is in the belt slots and can be quickly and simply adjusted to perfectly accommodate other belts of varying widths. Additional height adjustment can be accomplished by simply removing the three bolts securing the adjustable mount to the hip plate, turning the hip plate upside down and re-bolting the adjustable mount to the hip plate. An additional half inch in height adjustment is thus made. As configured, the height adjustment guides will allow nine different widths of belts to be accommodated by the hip plate. Conventional shoulder holsters offer none.

The invention also includes methods for constructing a strapless shoulder holster and a thigh holster.

DETAILED DESCRIPTION OF THE PREFERRED EMBODIMENTS

Figure 1:
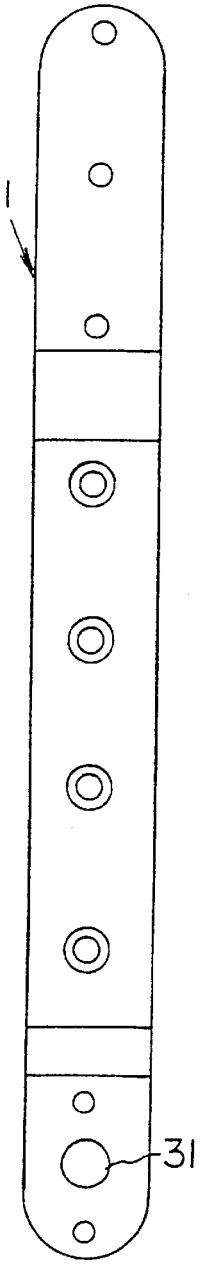
FIG. 1 is a front view of an adjustable mount, according to the invention.
Figure 2:
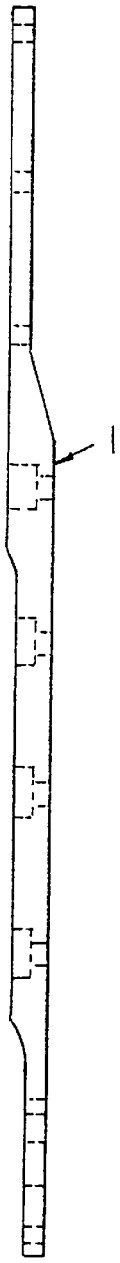
FIG. 2 is a side view of the adjustable mount of FIG. 1.

FIGS. 1 and 2 show an adjustable mount (1) in front view and side view, respectively. The adjustable mount is preferably an elongated strip, with a plurality of bores therein.

Figure 3:
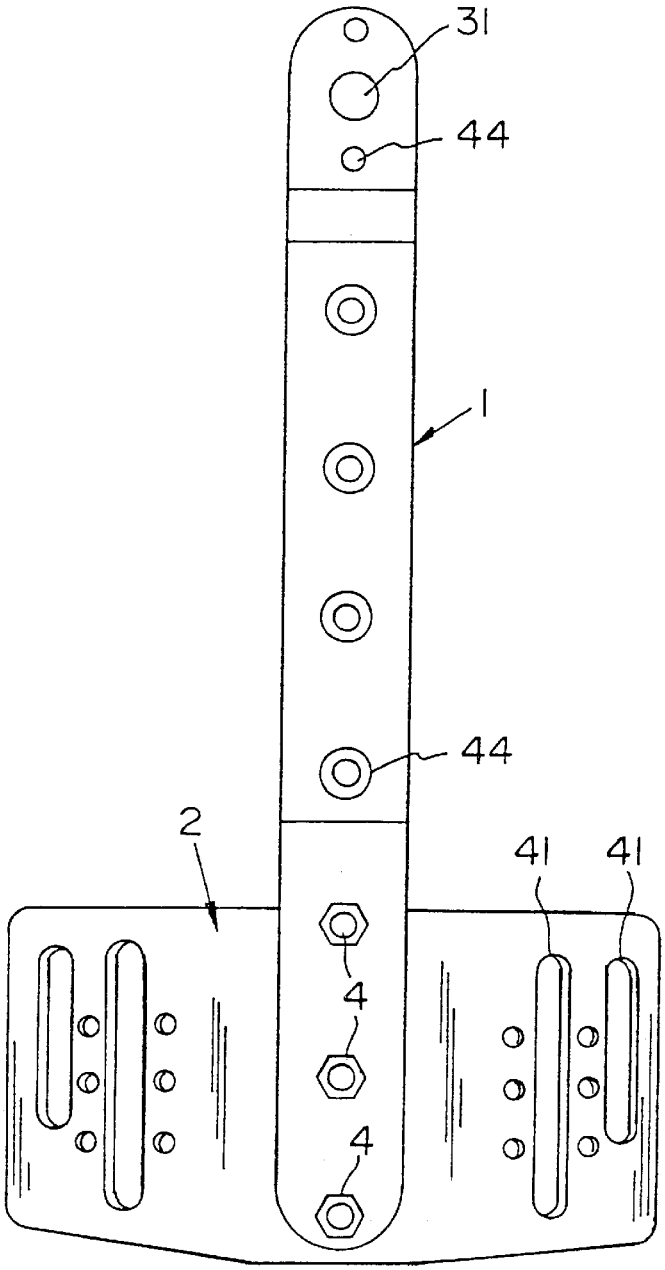
FIG. 3 is a front view of an adjustable mount secured to a hip plate, according to the invention.

FIG. 3 shows the adjustable mount (1) secured to a hip plate (2), secured thusly by hip plate bolts (4) and also showing belt traction retention slots (41). Adjustable mount (1) has shroud bolt holes (44).

Figure 4:
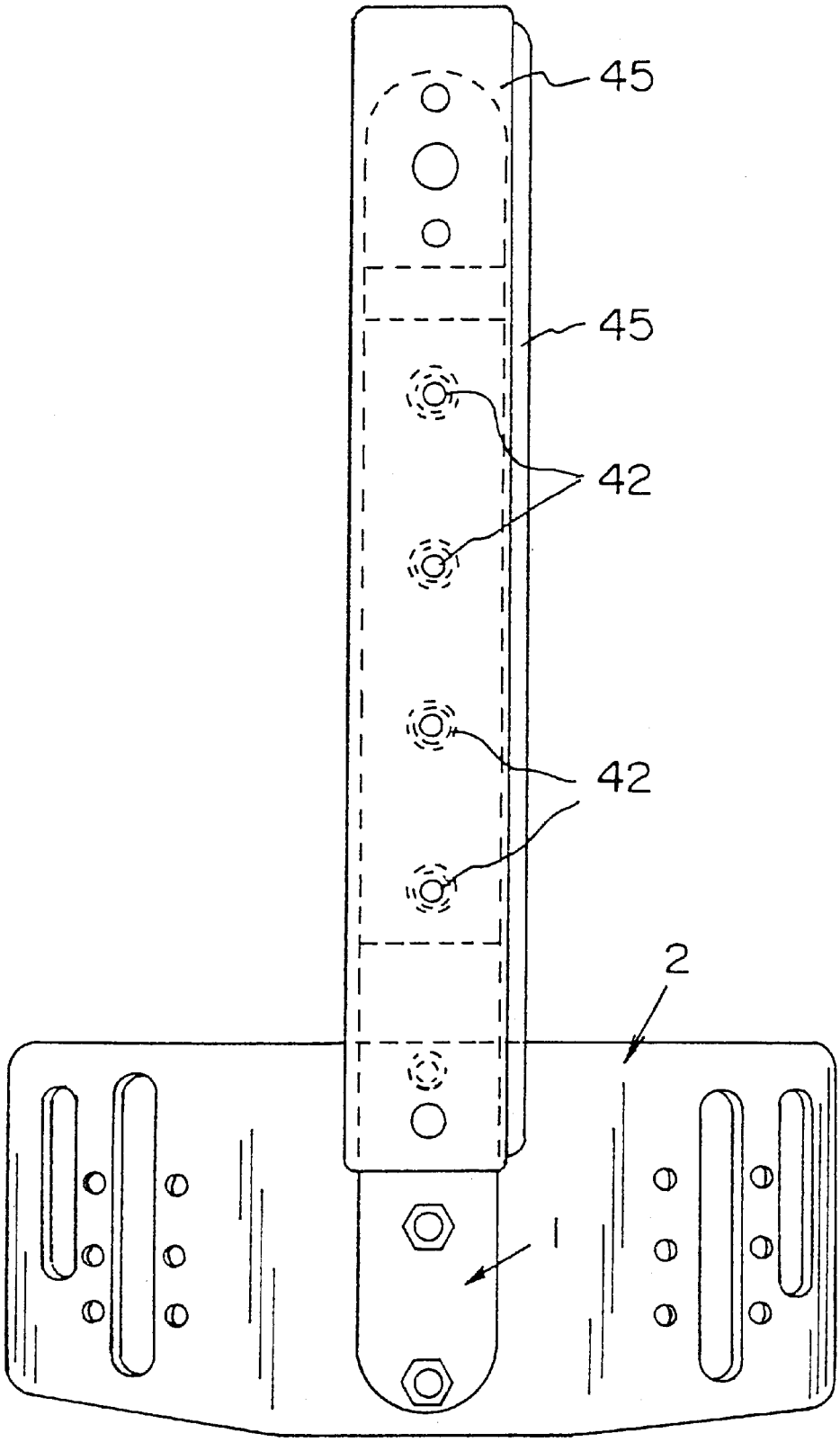
FIG. 4 is a front view showing a shroud attached to the adjustable mount and hip plate of FIG. 3.

FIG. 4 shows a shroud (45) attached to the adjustable mount (1) by bolts (42) which are received in mating holes (44) of mount (1) and holes (44') in shroud (45). Holes (44') in shroud (45) may be internally threaded. Holes (44') are located on both sides of shroud (45), for left hand or right hand wearing.

Figure 5:
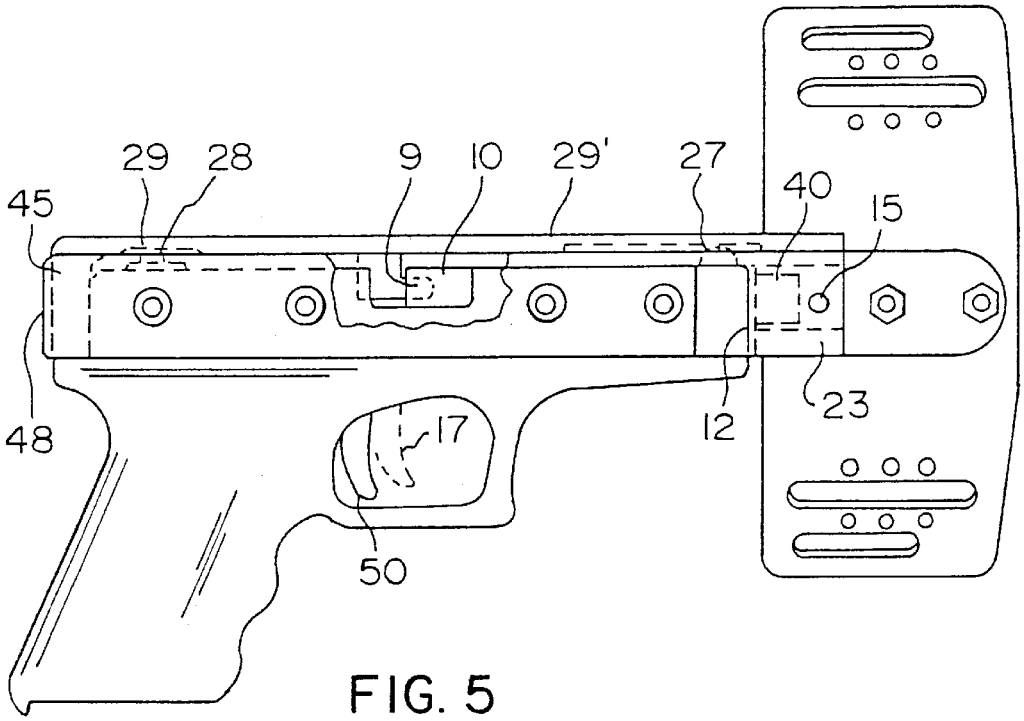
FIG. 5 is a front view showing a pistol secured in the shroud of FIG. 4.

Referring to FIG. 5, an anti-grab guard (48) is on shroud (45) with the pistol rear sight (28) protected by the slide shroud sight protection groove (29). The action locking lug (9) is in the firing chamber of the pistol (10) restricting any loaded ammunition from being in the pistol's firing chamber if the pistol is in the holster. Additionally, the action locking lug (9) keeps the slide partially open, thereby moving the trigger of the pistol (17) to an inoperative locked trigger position (50). The pistol front sight (27) is protected as is the rear sight by a non-contacting presence with the slide shroud sight protection groove (29'). The barrel end (40) owing to the pistol's slide being retained partially open by the presence of the action locking lug (9) hold in position by the force of the pistol's compressed recoil spring within the firing chamber (10) causes said barrel end (40) to enter into the barrel port (23) as the slide is precluded from movement by the slide blocking platform (12).

Figure 6:
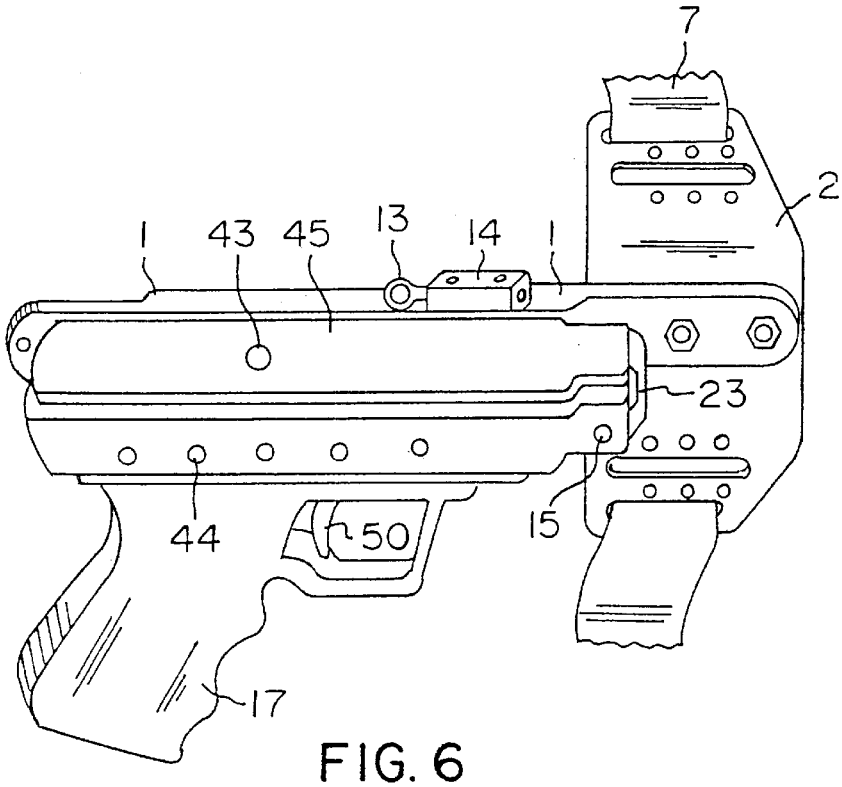
FIG. 6 is a front view of the invention of FIG. 5, further showing a ringed tactical safety pin positioned in a storage port on the adjustable mount, with a belt located in slots on the hip plate.

FIG. 6 is a perspective view showing the action locking lug platform retention bolt (43) secured by a sheathed threaded bolt. A ringed tactical safety pin storage port (14) is secured to the side of the adjustable mount (1). The barrel blocking lock port (15) is shown near the muzzle end of the holster. Adjustable mount (1) has slide shroud height adjustment bolt holes (44). As the pistol is secured in the holster, it is unloaded (i.e., round not chambered), trigger inoperable condition (50). Further details of the shroud (45), action locking lug (9) and their cooperation with pistol (17) may be seen in U.S. Pat. No. 5,768,816, incorporated herein by reference.

A ringed tactical safety pin (13) is inserted into the appropriate slot of the ringed tactical safety pin storage port (14). Trouser belt (7) is shown running through the hip plate (2). Ringed tactical safety pin (13) may be inserted in the barrel blocking lock port (15), so that the barrel may not exit the barrel port (23), shown at the bottom of the shroud (45).

Figure 7A:
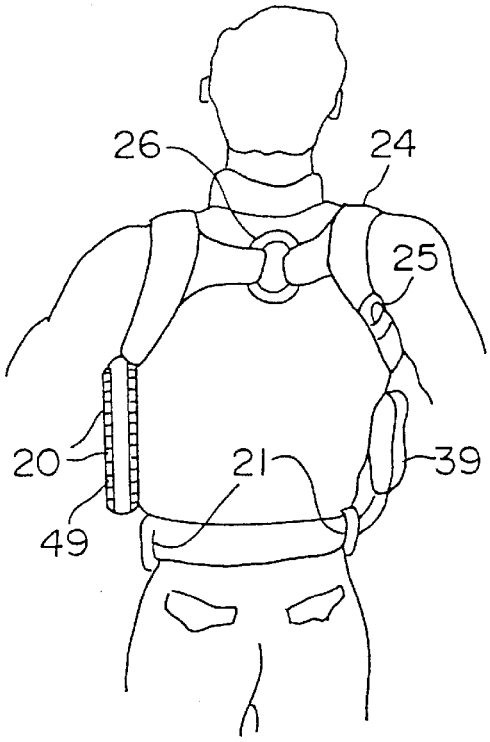
FIG. 7a PRIOR ART
FIGS. 7(*a*) and 7(*b*) are rear and front views of a person wearing a prior art shoulder holster.
Figure 7B:
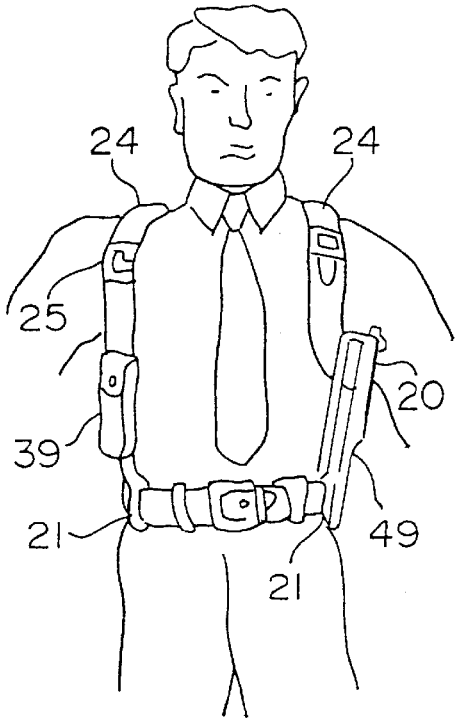
FIG. 7b PRIOR ART

FIGS. 7(*a*) and 7(*b*) show a loaded pistol (49) inserted into a conventional strapped shoulder holster (20) attached to leather/nylon strap loops (24), which are in turn attached to each other at the back of the wearer by the back strap joiners (26). The leather/nylon strap loops (24) are held in place by the leather/nylon strap buckles (25). The spare magazine counterweight pouch (39) is attached to leather/nylon strap loops (24). The holster tie down retainers (21) are secured to the wearer's belt. The conventional strapped shoulder holster (20) is shown with a pistol being carried in loaded pistol/trigger operable condition (49).

Figure 8A:
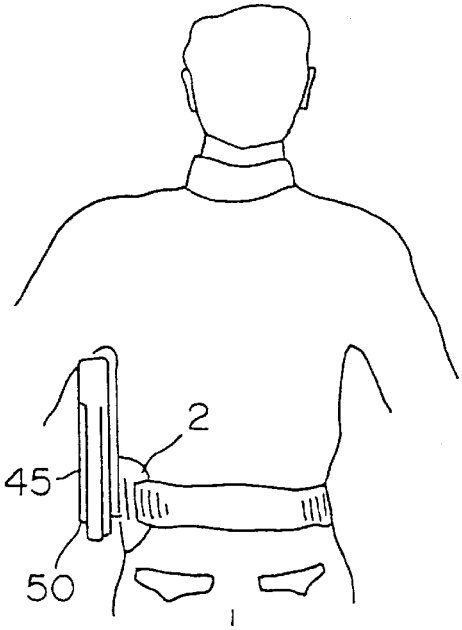
FIGS. 8(*a*) and 8(*b*) are rear and front views of a person wearing a strapless holster according to the invention.
Figure 8B:
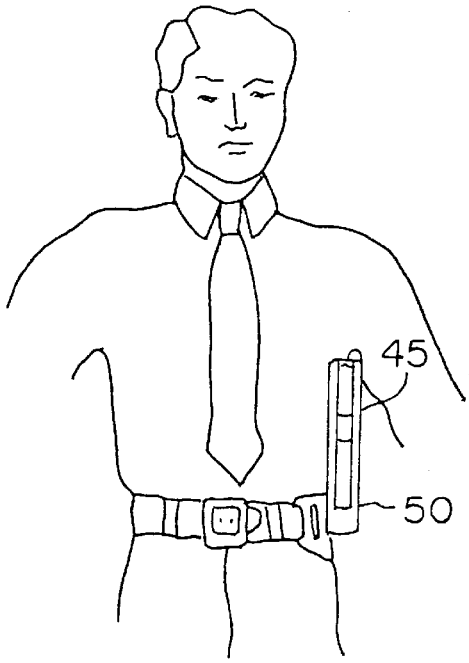
Figure 9A:
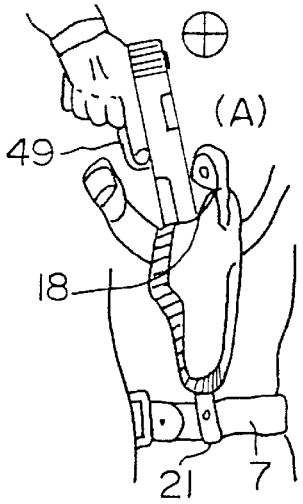
FIG. 9a PRIOR ART
FIGS. 9(*a*)–9(*d*) are side views showing the action of mounting a pistol in a prior art shoulder holster.
Figure 9B:
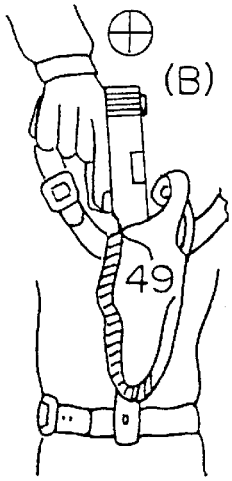
FIG. 9b PRIOR ART
Figure 9C:
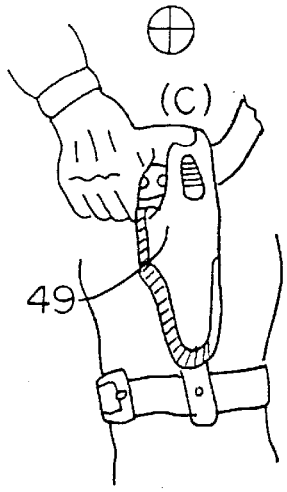
FIG. 9c PRIOR ART
Figure 9D:
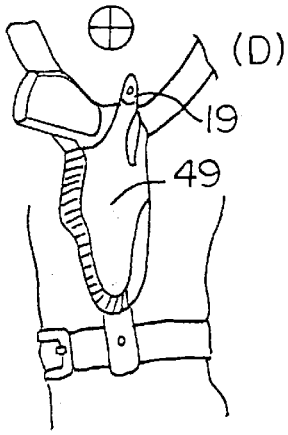
FIG. 9d PRIOR ART
Figure 10A:
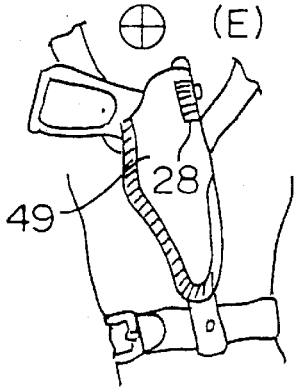
FIG. 10a PRIOR ART
FIGS. 10(*a*)–10(*d*) are side views showing the action of a person removing a pistol from a prior art shoulder holster.
Figure 10B:
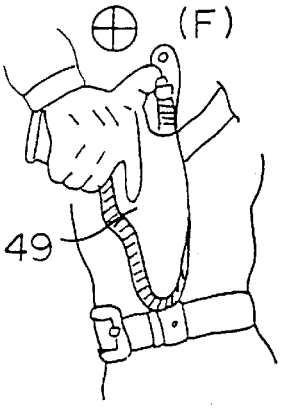
FIG. 10b PRIOR ART
Figure 10C:
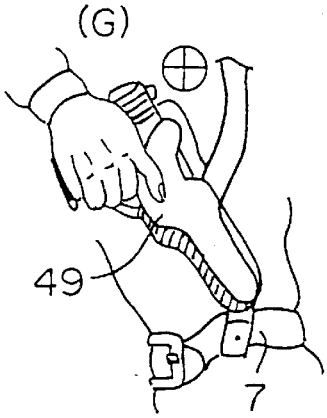
FIG. 10c PRIOR ART
Figure 10D:
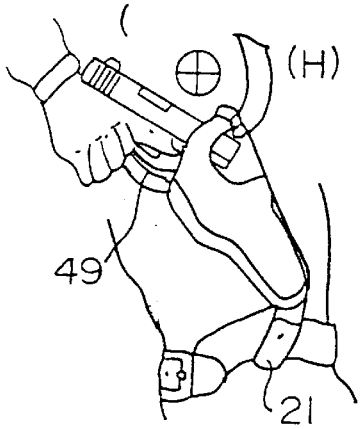
FIG. 10d PRIOR ART
Figure 11A:
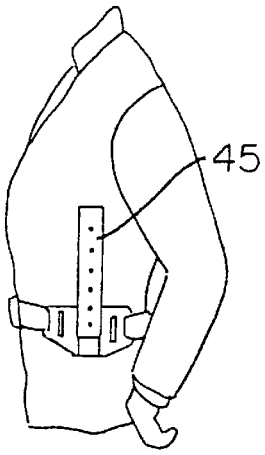
FIGS. 11(*a*)–11(*h*) are side views showing the action of a person first holstering then removing a pistol from a strapless holster according to the invention.
Figure 11B:
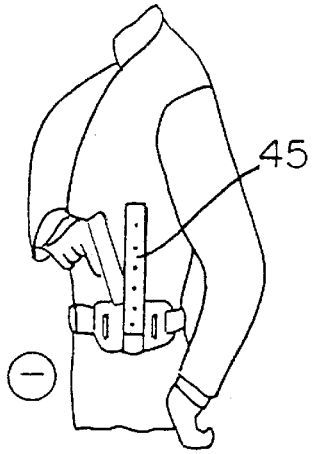
Figure 11C:
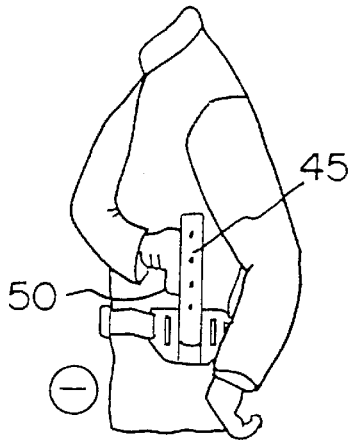
Figure 11D:
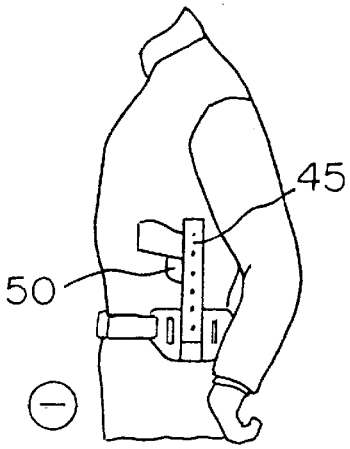
Figure 11E:
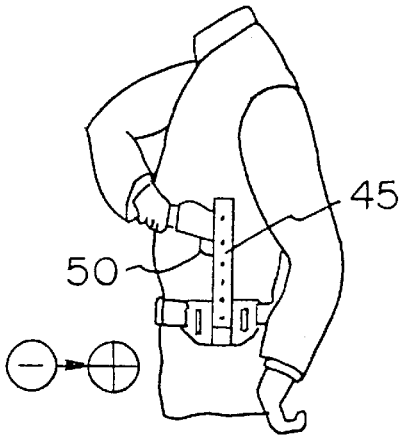
Figure 11F:
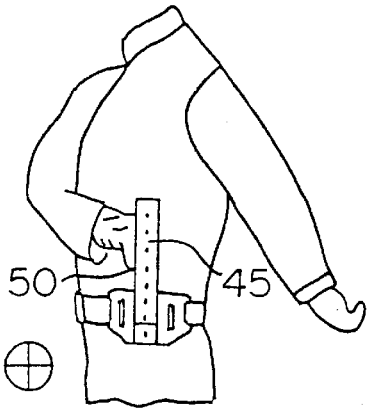
Figure 11G:
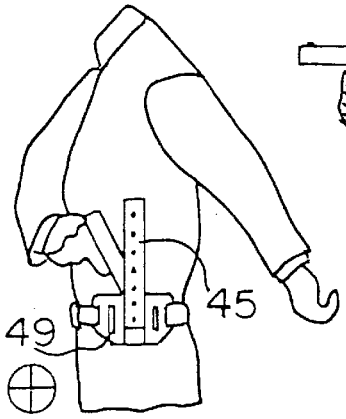
Figure 11H:
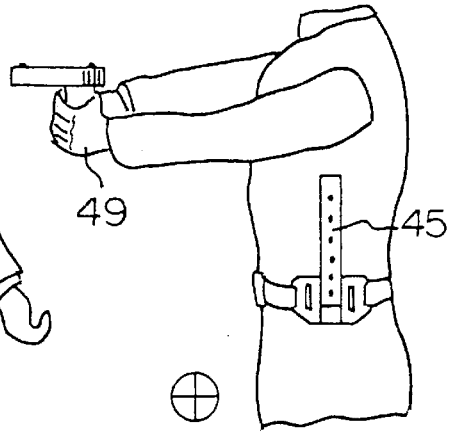

In FIGS. 8(*a*) and 8(*b*), the hip plate (2) of the invention is seen with a pistol (50) locked in the shroud (45).

FIGS. 9(*a*)–(*d*) and 10(*a*)–(*d*) show the holstering and drawing of a pistol in a conventional shoulder holster in various holstering and drawing positions indicated by letters (A) through (H). The disk with a cross therein indicates a loaded magazine in the pistol which takes place in all of these drawings. The thumb release retention strap (18) is shown being manipulated throughout several of these letters (A) through (H). The pistol being handled is loaded pistol/trigger operable condition (49). Also, please note the torsional effect of the holstering and drawing of the pistol in a conventional shoulder holster causes pressure on the wearer's belt (7) connected to the conventional holster (20) by the holster tie down retainers (21). Pistol rear sight (28) is at all times subject to entanglement with the thumb release retention strap (18) and is constantly subjected to snagging of the wearer's clothing on holstering or drawing the pistol as well as rust accumulating and binding the metal snap due to perspiration under the armpit of the wearer.

Similarly indicated by letters (A) through (H) in FIGS. 11(*a*)–(*h*), shroud (45) is seen mounted in FIG. 11(*a*). Letter (B) shows the empty pistol without a magazine (indicated as previously mentioned by a circle containing a minus sign) in the shroud (45). Letter (C) shows the unloaded pistol being inserted into the holster by its downward and rearward motion. Letter (D) shows the pistol thusly secured in unloaded pistol/trigger inoperable condition (50). Letter (E) shows inserting a loaded magazine into the holster transitioning from empty grip (–) to loaded magazine in grip (+) in their respective disks. Letter (F) shows the commencement of the drawing action which automatically loads the pistol and in this position the pistol is unloaded/trigger inoperable condition (50) by pushing down on the pistol's grip. Letter (G) shows the pistol being withdrawn from the holster with a loaded magazine whereby upon the withdrawal of the pistol it automatically loads into loaded pistol/trigger operable condition (49). Letter (H) shows the pistol in loaded pistol trigger operable (49) aimed for firing. Please note that in all of these drawings, the pistol is drawn never pointing at any part of the wearer's body with the pistol loaded and fireable.

Figure 12:
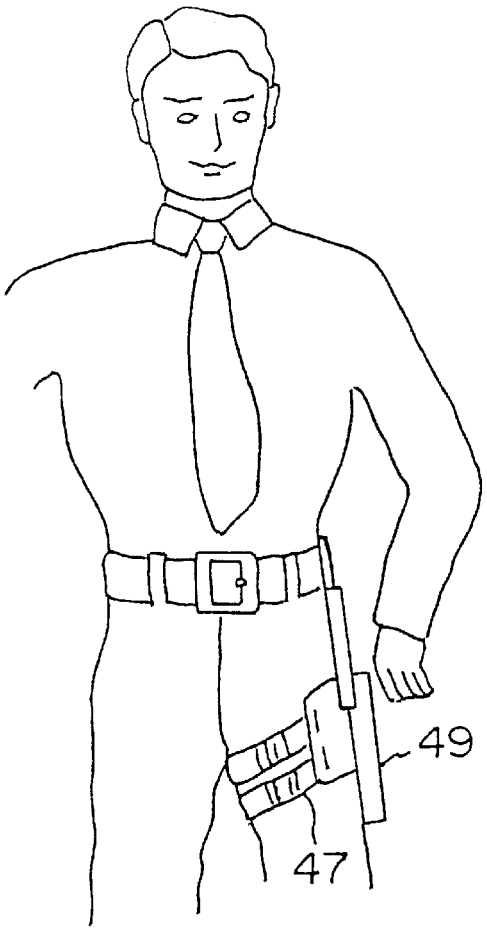
FIG. 12 PRIOR ART
FIG. 12 is a front view of a person wearing a prior art thigh holster.
Figure 13:
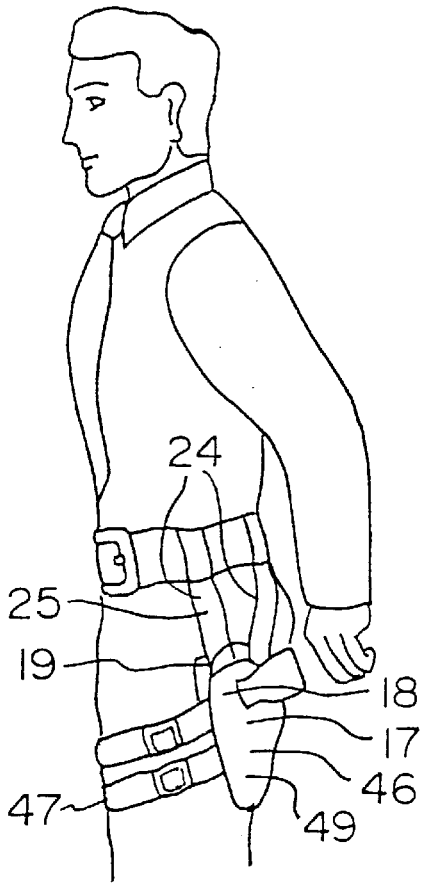
FIG. 13 PRIOR ART
FIG. 13 is a side view of the person and thigh holster of the prior art, shown in FIG. 12.
Figure 14:
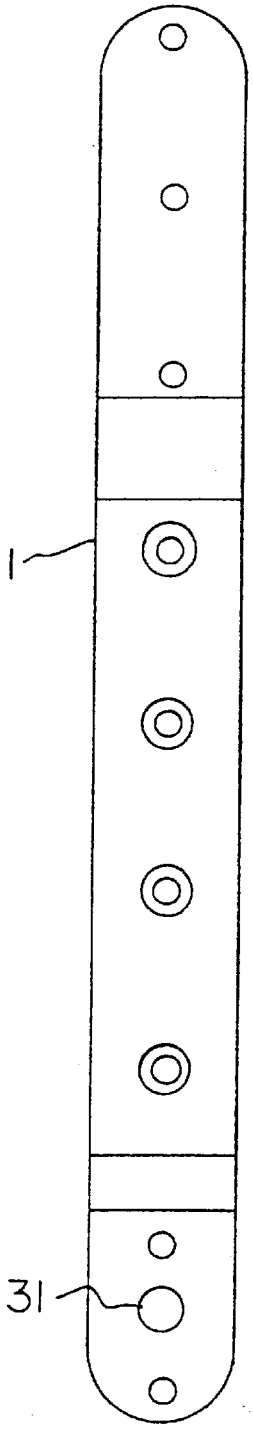
FIG. 14 is a front view of an upper adjustable mount, for use in connection with the thigh holster according to the invention.
Figure 15:
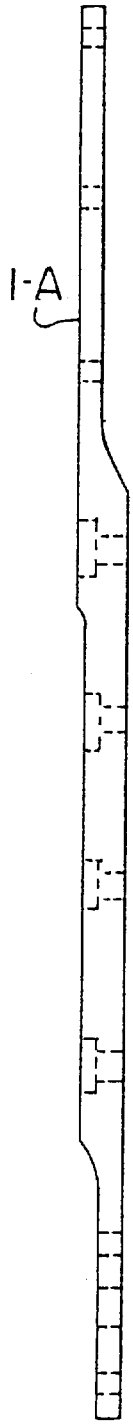
FIG. 15 is a side view of the upper adjustable mount of FIG. 14.
Figure 16:
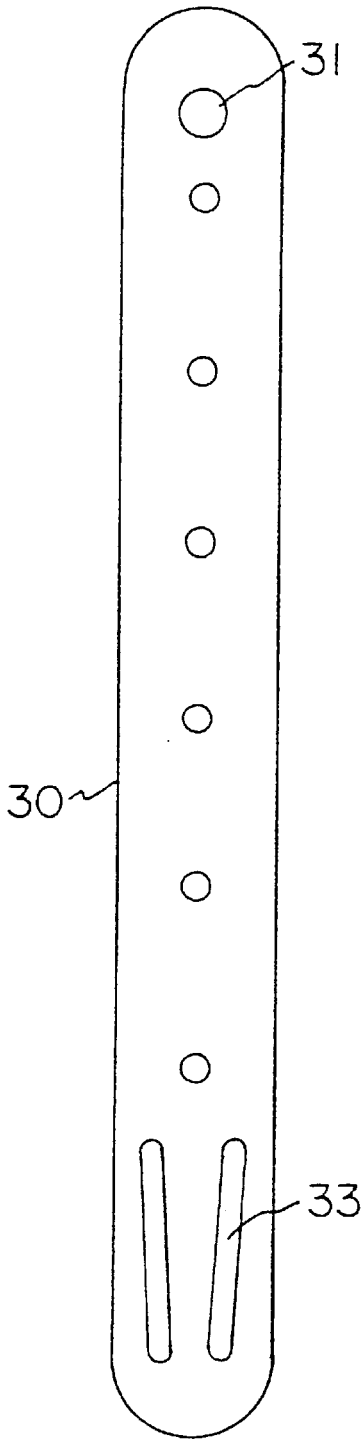
FIG. 16 is a front view of a lower adjustable mount for use in connection with the thigh holster according to the present invention.
Figure 17:
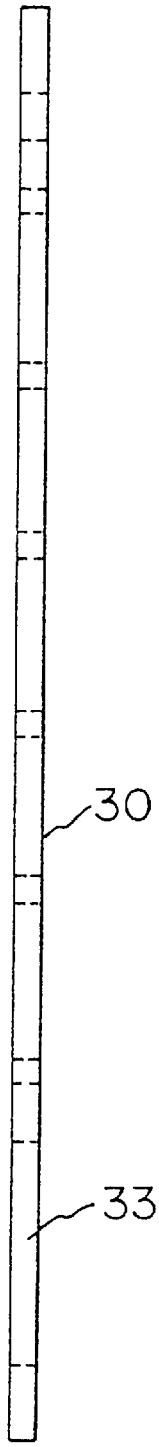
FIG. 17 is a side view of the lower adjustable mount of FIG. 16.

FIGS. 12 and 13 show a conventional holster of leather/nylon strap loops (24) attached to leather/nylon strap buckles (25) worn in a thigh holster configuration and restrained by holster thigh strap (47). The thumb release retention strap (19) is secured by the thumb release retention snap (18). The pistol trigger (17) is loaded pistol/trigger operable condition (49) in the conventional thigh holster (46).

FIGS. 14–17 show adjustable mount (1) with the adjustable lower mount (30) which has an aligning hole (31) the purpose of which is to secure both adjustable mounts to each other, for use in the thigh holster mode. Adjustable lower mount belt slots are shown as (33).

Figure 18:
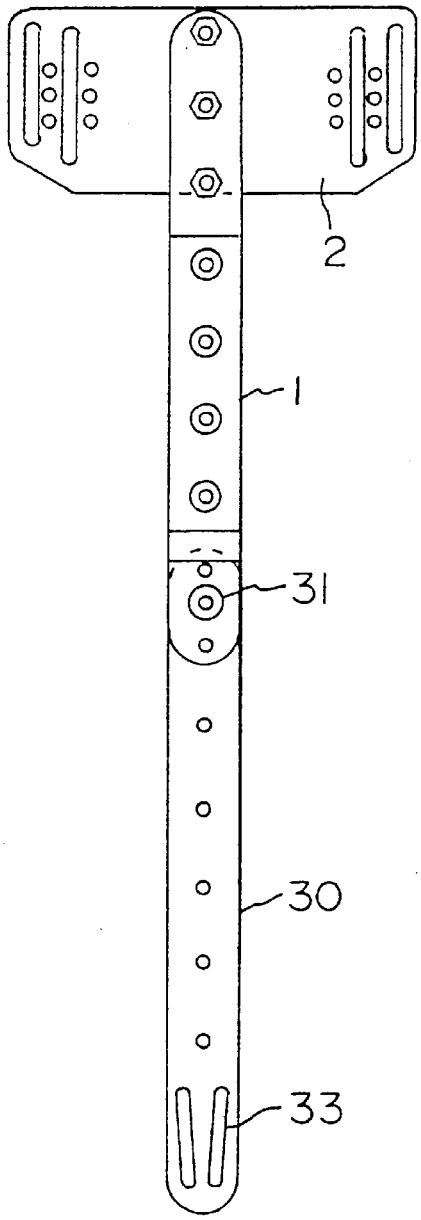
FIG. 18 is a front view of a hip plate, with downwardly extending adjustable mounts for use as a thigh holster, according to the invention.
Figure 19:
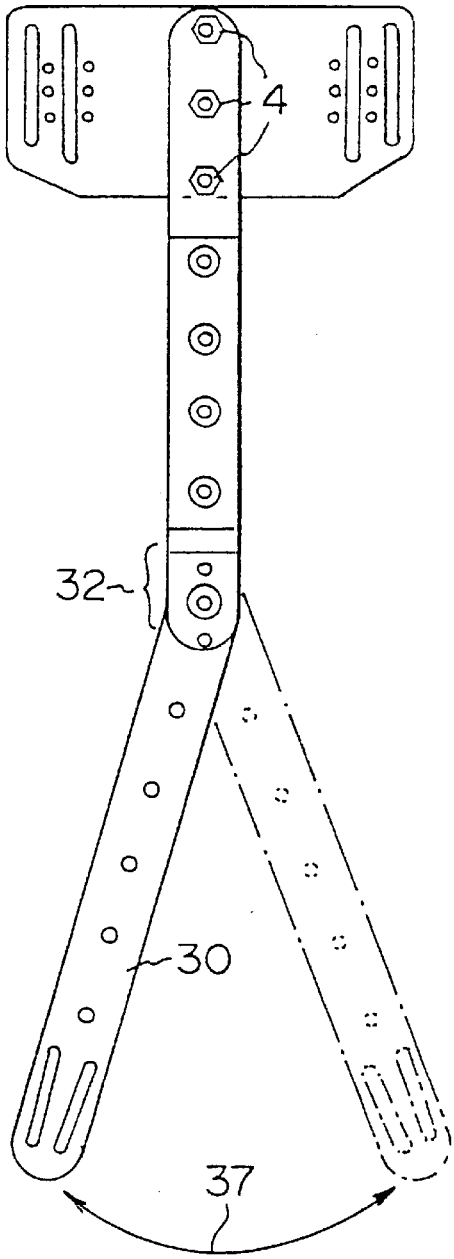
FIG. 19 is a front view of the hip plate and mounts of FIG. 18, showing a range of motion.

In FIGS. 18 and 19, the hip plate (2) is shown secured to the adjustable mount (1) by the hip plate bolts (4). Aligning hole (31) is shown connecting the mounts together. Rotating arc (37) of lower mount (30) is made possible by a bolt connecting both mounts through aligning hole (31), forming a rotary hinge (32).

Figure 20:
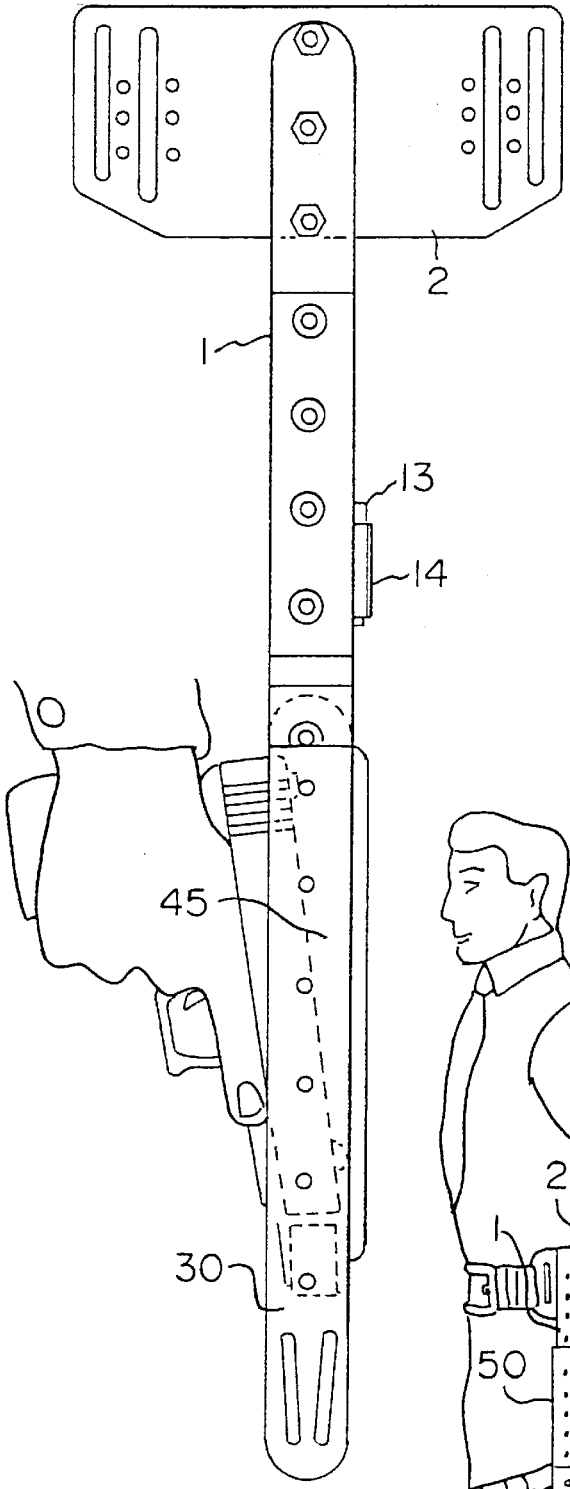
FIG. 20 is a front view of the hip plate and mounts of FIG. 18, with a shroud secured to the lower mount and a ringed tactical safety pin storage port secured to the upper mount.

In FIG. 20, ringed tactical safety pin (13) is shown inserted in the ringed tactical safety pin storage port (14) on adjustable mount (1).

Figure 21:
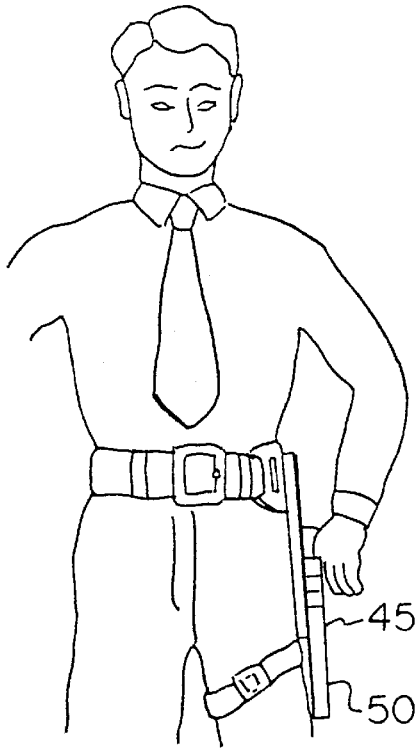
FIG. 21 is a front view of a person wearing a thigh holster according to the invention.
Figure 22:
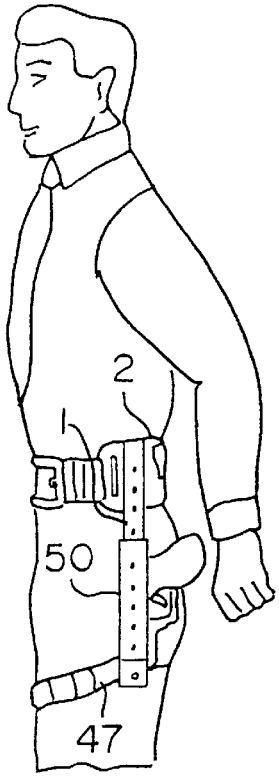
FIG. 22 is a side view of the person and thigh holster of FIG. 21.
Figure 23:
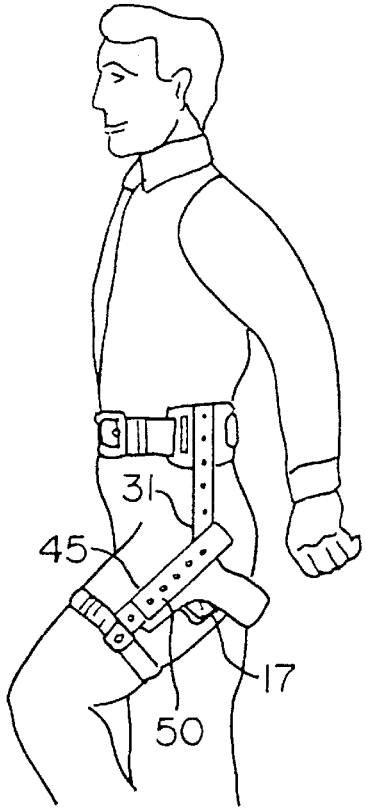
FIG. 23 is a side view of the person and thigh holster of FIG. 21, showing movement of the thigh holster with movement of the person's leg.

FIGS. 21–23 show the thigh holster and pistol carried in unloaded pistol/trigger inoperable condition (50), the lower mount (30) secured to the thigh by holster thigh strap (47), allowing the lower mount (30) to rotate in relation to the adjustable mount (1) attached to the hip plate (2), by means of a bolted aligning hole at (31). The pistol thus carried has its pistol trigger (17) in unloaded pistol/trigger inoperable condition (50).

Figure 24:
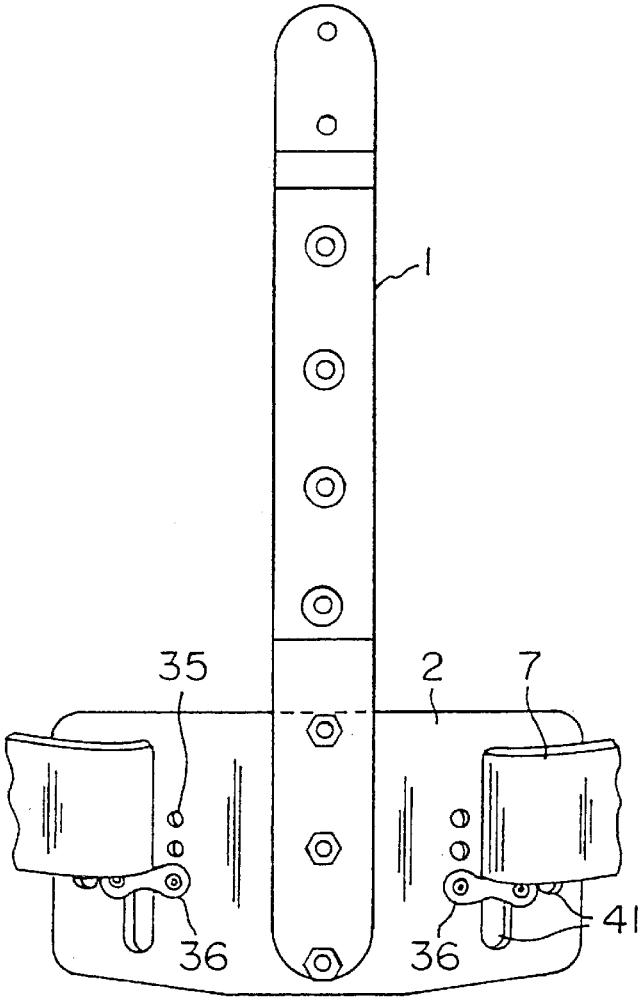
FIG. 24 is a front view of a hip plate and adjustable mount, showing belt height adjustment guides on the hip plate.

Belt height adjustment guide plates (36) are shown in FIG. 24 in two ways; slight notch on top, deeper notch on bottom, or in inverted shape with slight notch on bottom, deep notch on top. The guide plates (36) are mounted by bolts into corresponding threaded vertical hip plate holes (35). Belt height adjustment guide plates (36) in their corresponding hip plate holes (35), in either upright or inverted mode, thereby allow any combination of their mounting to the hip plate (2) to correspond to any varying width of belt. This provides tight traction of the belt in relation to the hip plate (2) so as to maintain the holster in constant memorable positioning.

Particularly, the adjustable mount (1) is shown attached to hip plate (2). Trouser belt (7) is maintained at proper height to accommodate the width of trouser belt (7) by securing the belt height adjustment guide plates (36) through their corresponding vertical hip plate holes (35) in relation to belt traction retention slots (41).

Figure 25:
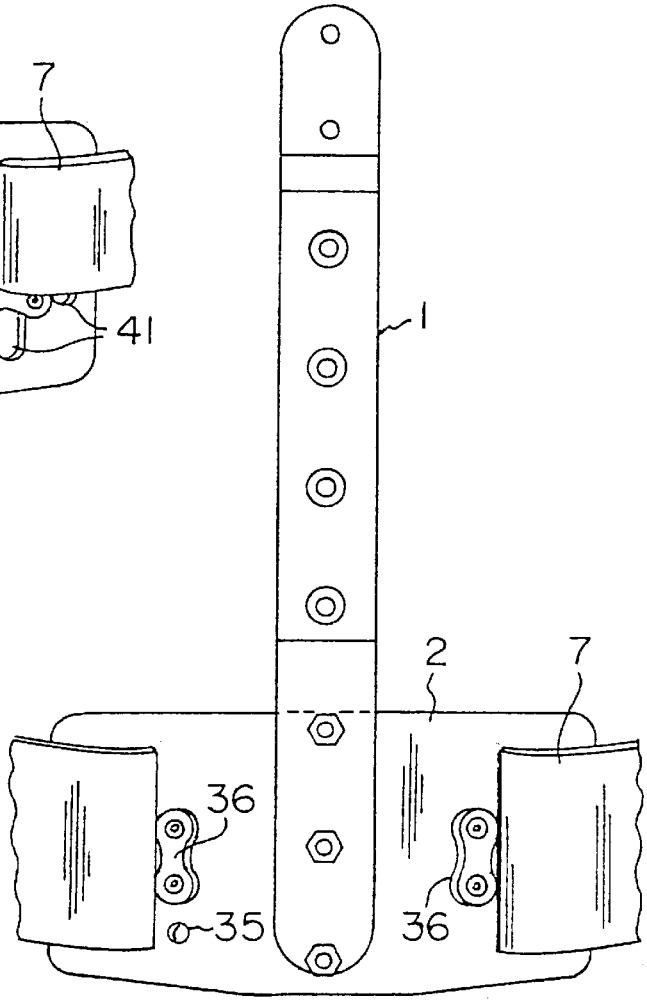
FIG. 25 is a further front view of the hip plate and adjustable mount of FIG. 24, showing the belt height adjustment guides in a disengaged position.

FIG. 25 shows the belt height adjustment guide plates (36) vertically secured to corresponding vertical hip plate holes (35) in a secured storage mode thereby allowing the maximum width of a trouser belt (7) to pass through the slots of the hip plate (2).

Figure 26:
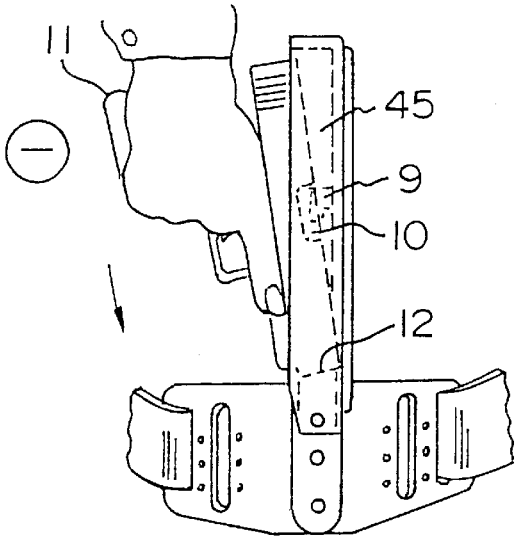
FIG. 26 is a front view showing insertion of a pistol into a shroud, utilizing the holster according to the invention.

FIG. 26 shows the holstering of an unloaded pistol into the shroud (45) with no loaded magazine present in the grip of the pistol as indicated by the disk containing a minus sign. The pistol grip (11) held firmly in the hand of the operator positions the pistol in the holster so that the muzzle end of the pistol bears on the slide blocking platform (12) which will restrict the downward motion of the pistol's slide. The closed firing chamber (10) is bearing on the action locking lug (9).

Figure 27:
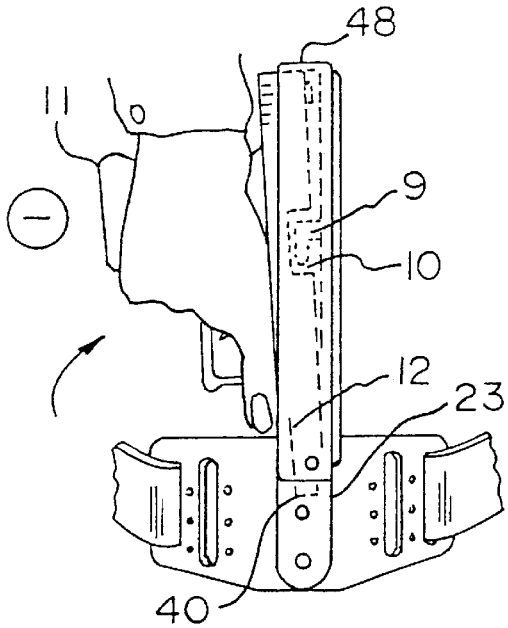
FIG. 27 is a further detail view of inserting the pistol into the holster according to the invention.

In FIG. 27, the operator pushes down fully on the pistol grip (11) thereby allowing the frame of the pistol to go downward while at the same time the muzzle end of the pistol's slide is restrained from moving in the same direction by slide blocking platform (12) of the holster thereby allowing the barrel end (40) to pass fully through the barrel port (23) which causes the firing chamber (10) to open as the pistol is rotated forward into the holster as indicated by the arrow. The rear end of the pistol's slide comes into contact with holster shroud retention anti-grab guard (48).

Figure 28:
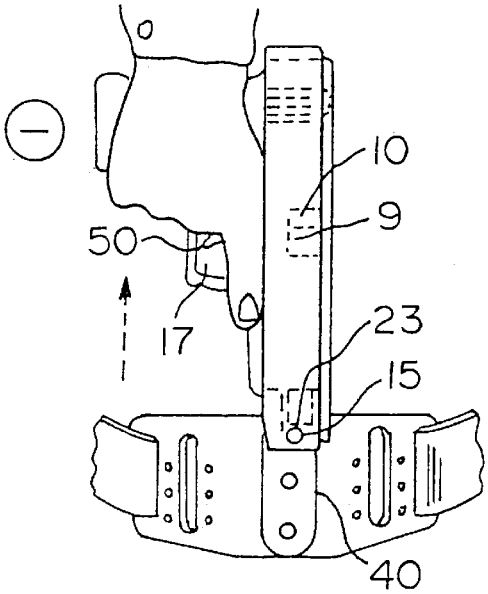
FIG. 28 shows a pistol inserted into a holster according to the invention, illustrating upward retraction of a pistol barrel through a barrel port of a shroud.

In FIG. 28, the barrel end (40) retracts upward through the barrel port (23) as the operator allows the compressed recoil spring of the pistol to expand during the relaxed pressure of the operator's hand which allows the pistol to lock in the holster. This allows the pistol to lock in the holster which simultaneously locks the action locking lug (9) into the firing chamber (10). This keeps the firing chamber (10) partially open thereby restricting the pistol trigger (17) from being functioned as the pistol's own internal disconnect lever prevents the trigger from operating unless the firing chamber (10) is completely closed. The pistol is now in unloaded pistol/trigger inoperable condition (50).

Figure 29:
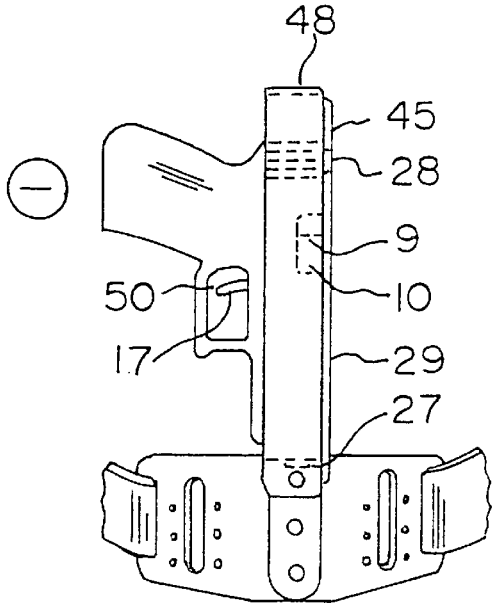
FIG. 29 is a front view showing a pistol securely locked in a holster according to the invention.

FIG. 29 shows the pistol thus contained locked securely in the shroud (45) with the pistol front sight (27) and rear sight (28) protected in slide shroud sight protection groove (29).

Figure 30:
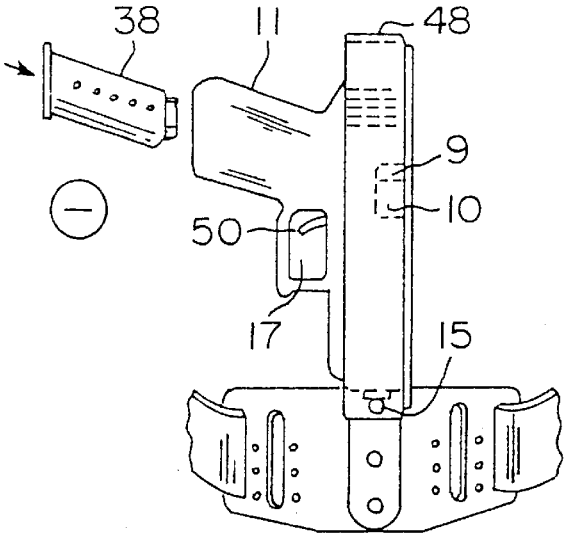
FIGS. 30 and 31 show insertion of a magazine into a pistol grip.

In FIG. 30, the pistol is locked in the holster in an unloadable state. A loaded magazine (38) may be inserted into the pistol grip (11).

Figure 31:
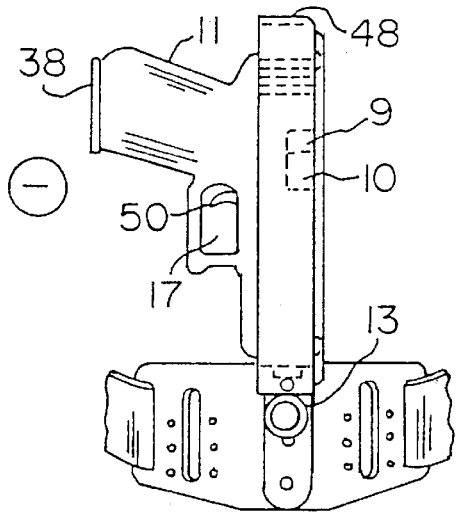

FIG. 31 shows that although a loaded magazine (38) is inserted in the pistol grip (11), the action locking lug (9) keeps the slide and thus the firing chamber (10) partially open. The lug of the action locking lug (9) is within the bore of the barrel. The pistol trigger (17) is thus inoperable. The ringed tactical safety pin (13) is seen inserted in the barrel blocking lock port (15), thereby preventing the pistol from being removed from the holster until the operator removes the ringed tactical safety pin from the barrel blocking port.

Figure 32:
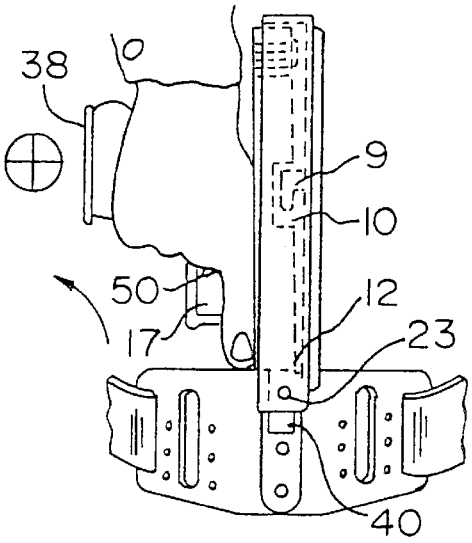
FIGS. 32–34 illustrate removal of a pistol from a holster according to the invention.

In FIG. 32, although a loaded magazine (38) is within the grip of the pistol, the presence of the action locking lug (9) in the firing chamber (10) renders the trigger and the pistol inoperative. By pushing down, the slide blocking platform (12) restrains any movement of the slide thereby allowing the barrel to pass through the barrel port (23). This allows the downward action by the operator on the grip and frame of the pistol. The grip and hence frame of the pistol are pushed to the most downward position allowed by the slide blocking platform (12) thereby allowing the firing chamber (10) to open fully. The action locking lug (9) is then freed of the fully open firing chamber by the rearward movement of the operator's hand as indicated by the arrow. The pistol is still maintained in unloaded pistol/trigger inoperable condition (50).

Figure 33:
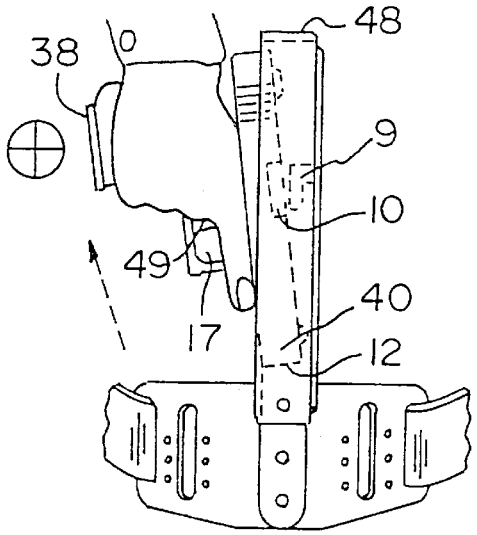

In FIG. 33, as indicated by the upward arrow indicating released downward pressure by the operator's hand, the grip and frame of the pistol will move upward in line with the now closed firing chamber (10). The action locking lug (9) has thus withdrawn from the firing chamber (10), and the barrel end (40) has withdrawn inside the pistol's slide. Consequently, the presence of a loaded magazine (38) in the grip working in relation to the now closing slide has automatically indexed a cartridge by way of the magazine's spring. The spring exerts an upward pressure, positioning a cartridge to be loaded into battery and renders the pistol in loaded pistol/trigger operable condition (49).

Figure 34:
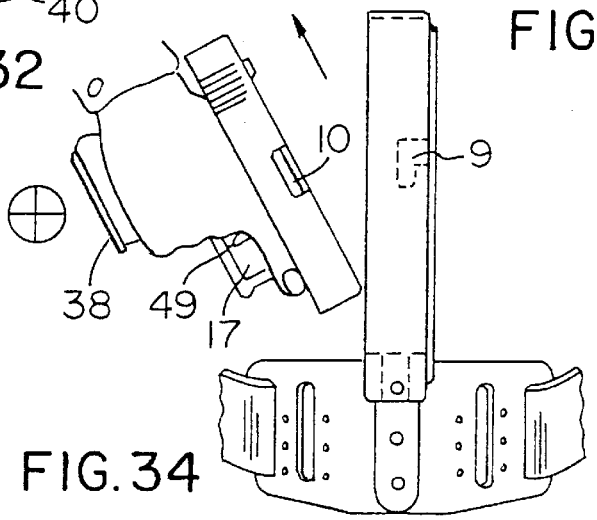

FIG. 34 shows the pistol now fully loaded and cocked being withdrawn in an upward action. The pistol's slide clears the holster within less than one and a half inches as opposed to the six inch clearance required to withdraw a pistol from a conventional shoulder holster.

It will be understood that the pistol is holstered and withdrawn from the thigh holster of the present invention, in a similar manner to that described above.

Figure 35:
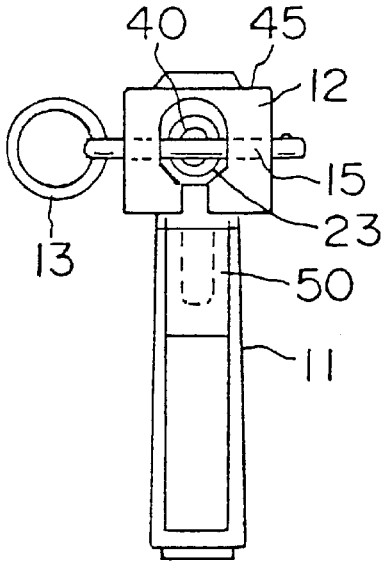
FIG. 35 is a front view showing a ringed tactical safety pin inserted through a barrel locking lock port, according to the invention.

FIG. 35 indicates the front view of a pistol locked in the holster whereby the ringed tactical safety pin (13) is inserted through the barrel blocking lock port (15). As the pistol thusly holstered would be with its barrel end (40) positioned behind (15), it is restricted from passing through the barrel port (23) thereby not allowing the pistol to either be loaded or removed from the holster without the ringed tactical safety pin being removed. The pistol is thus safely carried with an additional safety measure in unloaded pistol/trigger inoperable condition (50).

Figure 36:
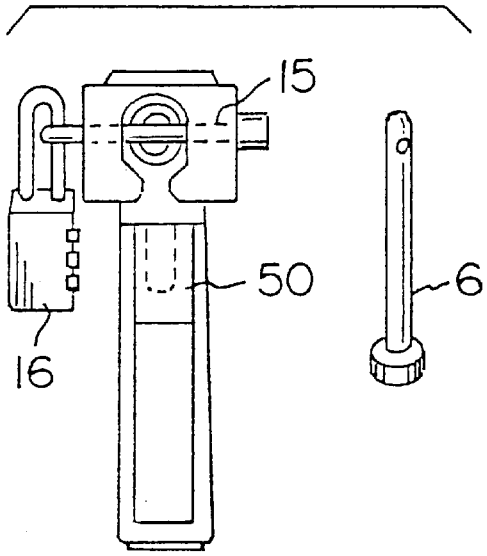
FIGS. 36 and 37 show alternatives to the ringed tactical safety pin of FIG. 35.

For safekeeping at home with excellent security against children or other unauthorized use, FIG. 36 shows a secondary locking mechanism, the barrel blocking lock rod (6) being contained in the barrel blocking lock port (15). A combination lock (16) is secured through the hole of the barrel blocking lock rod (6). The pistol is again in unloaded pistol/trigger inoperable condition (50) and cannot be removed or field stripped from the holster without removal of the locks so placed.

Figure 37:
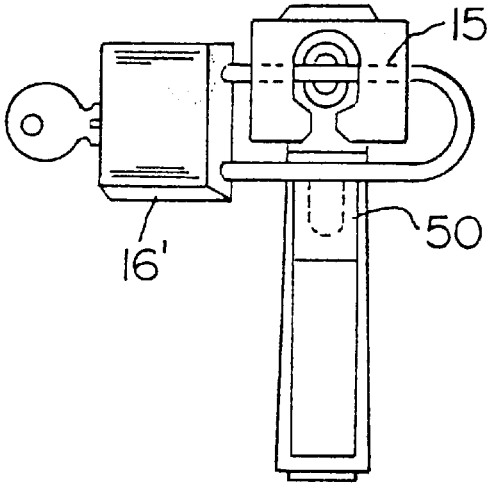

As an alternative to a combination lock, FIG. 37 shows a keyed lock (16') being secured through the barrel blocking lock port (15) thereby rendering the pistol again in unloaded pistol/trigger inoperable condition (50) and not capable of being removed or field stripped from the holster without the removal of the lock so placed.

While the present invention has previously been described with respect to the current preferred embodiments, it is envisioned that other modifications and additions to the invention hereinbefore described may be made by those skilled in the art. It is intended that such modifications and additions be included within the scope of the present invention, insofar as set forth in the following claims and equivalents thereof.

I claim:

1. A strapless shoulder holster, comprising:

a hip plate;

at least one adjustable mount removably connected with the hip plate, said mount having shroud mounting means thereon, a major portion of said mount extending vertically upward from said hip plate;

means for mounting the hip plate on a wearer's article of clothing; and a shroud for removably receiving a firearm, said shroud secured to the adjustable mount via the shroud mounting means.

2. The holster of claim 1 wherein the adjustable mount is secured to the hip plate via a plurality of bolts.

3. The holster of claim 1 wherein the shroud has at least one internal groove for passage of a pistol sight therethrough.

4. The holster of claim 1 wherein the adjustable mount is an elongated strip having a plurality of bores therein.

5. The holster of claim 4 wherein the shroud is secured to the adjustable mount by a plurality of bolts which are received in the bores on said mount.

6. The holster of claim 1 including a safety pin storage bore located on said adjustable mount.

7. The holster of claim 6 including a safety pin having a finger ring stowed in the safety pin storage bore.

8. The holster of claim 1 wherein the hip plate includes a plurality of slots for receiving a belt.

9. The holster of claim 8 including at least one belt height adjustment guide on the hip plate.

10. The holster of claim 1 including two adjustable mounts, each comprising an elongated strip with bores therein, said adjustable mounts hingedly connected to one another, with an upper one of said mounts connected to said hip plate, said shroud received on a lower one of said mounts, said lower mount further having means for securing the lower mount to a wearer's leg.

11. The holster of claim 10 wherein the means for securing the lower mount to a wearer's leg comprises a pair of slots on a distal end of the lower mount for receiving a belt that is to be secured around the wearer's leg.

12. The holster of claim 10 wherein said hinged connection comprises a bolt received in mating bores on overlapping ends of said upper and lower mounts.

13. A method for constructing a strapless shoulder holster, comprising the steps of:

(a) providing a hip plate;

(b) securing an upstanding, elongated adjustable mount to the hip plate so that a major portion of the mount extends vertically above said hip plate; and (c) securing a pistol-receiving device to the upstanding, elongated adjustable mount.

14. The method of claim 13 wherein the pistol-receiving device is a shroud.

15. The method of claim 13 wherein the adjustable mount is secured to the hip plate by using at least one bolt received in at least one bore in each of the hip plate and the adjustable mount.

16. The method of claim 13 wherein the pistol-receiving device is secured to the adjustable mount by using at least one bolt received in at least one bore in each of the pistol-receiving device and the adjustable mount.

17. The method of claim 13 further including the step of donning the strapless shoulder holster by securing the hip plate to a trouser belt of a wearer.

18. A method for constructing a thigh holster, comprising the steps of:

(a) providing a hip plate;

(b) securing a downwardly extending, elongated first adjustable mount to the hip plate;

(c) securing a lower adjustable mount to a distal end of said first adjustable mount with a pivotal connection; and (d) securing a pistol-receiving device to said lower adjustable mount.

19. The method of claim 18 wherein said pistol-receiving device is a shroud.

20. The method of claim 18 wherein the adjustable mount is secured to the hip plate by using at least one bolt received in at least one bore in each of the hip plate and the adjustable mount.

21. The method of claim 18 wherein the pistol-receiving device is secured to the adjustable mount by using at least one bolt received in at least one bore in each of the pistol-receiving device and the adjustable mount.

22. The method of claim 18 further including the step of donning the thigh holster by securing the hip plate to a trouser belt of a wearer and strapping a distal end of the lower adjustable mount to a thigh of the wearer.

23. A holster, comprising:

a hip plate;

at least one adjustable mount removably connected with the hip plate, said mount having shroud mounting means thereon, with a safety pin storage bore located on said mount;

means for mounting a hip plate on a wearer's article of clothing; and a shroud for removably receiving a firearm, said shroud secured to the adjustable mount via the shroud mounting means.

24. The holster of claim 23 including a safety pin having a finger ring stowed in the safety pin storage bore.

25. A holster comprising:

a hip plate;

two adjustable mounts, each comprising an elongated strip with bores therein, said adjustable mounts hingedly connected to one another, with an upper one of said mounts connected to said hip plate, a lower one of said mounts having shroud mounting means thereon;

means for mounting the hip plate on a wearer's article of clothing;

a shroud for removably receiving a firearm, said shroud secured to the lower one of said mounts via the shroud mounting means; and means for securing the lower mount to a wearer's leg.

26. The holster of claim 25 wherein the means for securing the lower mount to a wearer's leg comprises a pair of slots on a distal end of the lower mount for receiving a belt that is to be secured around the wearer's leg.

27. The holster of claim 25 wherein said hinged connection comprises a bolt received in mating bores on overlapping ends of said upper and lower mounts.

* * * * *